United States Patent [19]

Tanaka et al.

[11] 4,107,502

[45] Aug. 15, 1978

[54] MICROWAVE OVEN

[75] Inventors: Junzo Tanaka, Fujiidera; Toshio Kai, Yamatokoriyama, both of Japan

[73] Assignee: Matsushita Electric Industrial Co., Ltd., Japan

[21] Appl. No.: 784,772

[22] Filed: Apr. 5, 1977

[30] Foreign Application Priority Data

Apr. 6, 1976 [JP] Japan ..... 51-38966

[51] Int. Cl.[2] ..... H05B 9/06

[52] U.S. Cl. ..... 219/10.55 F

[58] Field of Search ..... 219/10.55 R, 10.55 A, 219/10.55 F

[56] References Cited

U.S. PATENT DOCUMENTS

| | | | |
|---|---|---|---|
| 2,520,602 | 8/1950 | Linder | 219/10.55 F |
| 3,440,383 | 4/1969 | Smith | 219/10.55 R |
| 3,467,803 | 9/1969 | Ojelid | 219/10.55 M |
| 3,492,454 | 1/1970 | Smith | 219/10.55 F |
| 3,566,066 | 2/1971 | Borthwick et al. | 219/10.55 R |

FOREIGN PATENT DOCUMENTS

| | | | |
|---|---|---|---|
| 982,334 | 6/1951 | France | 219/10.55 |
| 1,533,426 | 6/1968 | France | 219/10.55 R |

*Primary Examiner*—J. V. Truhe
*Assistant Examiner*—Bernard Roskoski
*Attorney, Agent, or Firm*—Wenderoth, Lind & Ponack

[57] ABSTRACT

A microwave oven equipped with a rotary table or turntable includes a heating chamber whose rear wall is formed into a concave shape of semi-circular cross section approximately concentric with a rotational center of the rotary table to eliminate any idle space at corner portions in the heating chamber for providing an economical microwave oven of compact size, and also to prevent the rotary table from being locked by a large object to be heated which may be caught by the corner portions during rotation, with the simultaneous elimination of damage to an observation window due to spark discharge arising from a metallic material included in the object, and with the further improvement of uniform heating within the heating chamber.

5 Claims, 5 Drawing Figures

MICROWAVE OVEN

BACKGROUND OF THE INVENTION

The present invention relates to a high frequency heating apparatus and more particularly, to a microwave oven or electronic oven equipped with a rotary table or turntable for placing an object to be heated thereon.

A microwave oven which is now widely used essentially includes an oven-defining structure preferably of double wall construction provided therein with a heating cavity or heating chamber having a hingedly supported door which is adapted to selectively open and close an access opening formed at one side of the oven defining structure, and a magnetron assembly for generating high frequency energy so as to heat an object or food material placed within the heating cavity based on the principle of dielectric heating. Some known microwave ovens are further provided with rotary tables or turntables within the heating chambers for rotation together with the objects or food material mounted thereon so that the degree of heating for such objects is made uniform by causing them to move within the heating chambers.

Conventionally, it has been a general practice to provide most microwave ovens with heating chambers of a rectangular hexahedral shape, i.e., rectangular cubic six-walled, box-like configuration, irrespective of the presence of rotary tables, mainly because of the fact that the heating chamber of the rectangular hexahedral shape as described above is advantageous, particularly when the microwave oven is not provided with the rotary table, in that such a heating chamber is readily processed during the manufacture of the microwave oven, while the space within the heating chamber is appreciably increased for efficient use of the microwave oven. The conventional heating chamber of the above described configuration, however, is not necessarily best suited to a microwave oven equipped with the rotary table, since the corner portions at the rear of the heating chamber tend to be idle space with respect to the rotary table, and result in such inconveniences in some cases that the object or food material to be heated may be caught at such corner portions and lock or prevent the rotary table from rotation, thus resulting in burning up the driving source, in the worst case. Furthermore, in the conventional arrangement as described above, especially when a metallic spit or skewer is employed for spitting the food material to be heated, for example, in a barbecue cooking, such a spit mounted on the rotary table together with the food material tends to be brought extremely close to or into contact with walls defining the heating chamber or an inner surface of the door for the heating chamber, to generate an intensive electrical spark discharge therebetween during rotation of the rotary table. Particularly, the door is provide with an observation window formed, for example, by holding a punched metal sheet or wire netting between a transparent plate of synthetic resin and a reinforced glass plate for permitting the food material to be readily observed therethrough during cooking and also for preventing leakage of high frequency energy, and if such a metallic spit is brought close to or into contact with the observation window within the heating chamber during cooking, there is the danger that the glass plate will be damaged or wire netting will be broken due to spark discharge arising from the concentration of a high frequency electric field thereat.

In order to overcome the disadvantages as described above, there has conventionally been proposed, for example, by U.S. Pat. No. 3,467,803, a microwave oven in which the heating chamber is formed into a semi-spherical shape. The above prior art microwave oven, however, has such a disadvantage that when a rotary table is disposed therein, it is impossible to rotate the rotary table smoothly if a tall object or food material to be heated is placed close to the peripheral edge of the rotary table, and therefore, such high objects to be heated must undesirably be placed adjacent to the central portion of the rotary table, and thus the effect of uniformly heating the object through the employment of the rotary table is reduced to a large extent.

SUMMARY OF THE INVENTION

Accordingly, an essential object of the present invention is to provide a microwave oven equipped with a rotary table which is easy to operate and compact in size by removing the idle space in its heating chamber through elimination of corner portions at the rear of the heating chamber.

Another important object of the present invention is to provide a microwave oven of the above described type in which the rotary table is perfectly prevented from locking by eliminating the corner portions at the rear of the heating chamber whereat the object to be heated tends to be caught during rotation of the rotary table.

A further object of the present invention is to provide a microwave oven of the above described type in which increased safety and durability are achieved by forming the rear wall of the heating chamber into a concave shape of semi-circular cross section approximately concentric with the rotary table, so that the spacing between metallic material such as a pit or the like inserted into the food material placed on the rotary table and the wall of the heating chamber is restricted, thereby maintaining the metallic material away from an observation window of a door of the microwave oven, thus preventing spark discharge between such metallic material and the observation window.

A still further object of the present invention is to provide a microwave oven of the above described type in which the effect of uniformly heating the object to be heated within the heating chamber is further improved by causing high frequency energy to be effectively reflected at the concave wall surface provided at the rear of the heating chamber.

Another object of the present invention is to provide a microwave oven of the above described type which is superior in processability and workability through the integral formation of the side walls with the rear wall of the heating chamber, with consequent reduction in cost.

According to a preferred embodiment of the present invention, the microwave oven having a rotary table is provided with a heating chamber whose rear wall surface is formed into a concave shape of semi-circular cross section approximately concentric with a rotational center of the rotary table to eliminate any idle space at corner portions in the heating chamber for providing an economical microwave oven of compact size. The arrangement as described above is also particularly effective for eliminating disadvantages in the conventional microwave ovens that a large object to be heated tends to be caught by such corner portions during rotation of the rotary table, thereby causing the rotary table to be locked or prevented from rotation, and that an observation window in the door of the oven is damaged due to spark discharge arising from a metallic spit or the like brought close to the observation window during rotation of the rotary table. Furthermore, in the arrangement according to the present invention, since the high frequency energy is effectively reflected by the concave rear wall portion of the heating chamber, the effect of uniform heating within the heating chamber is further increased as compared with microwave ovens of conventional arrangement.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
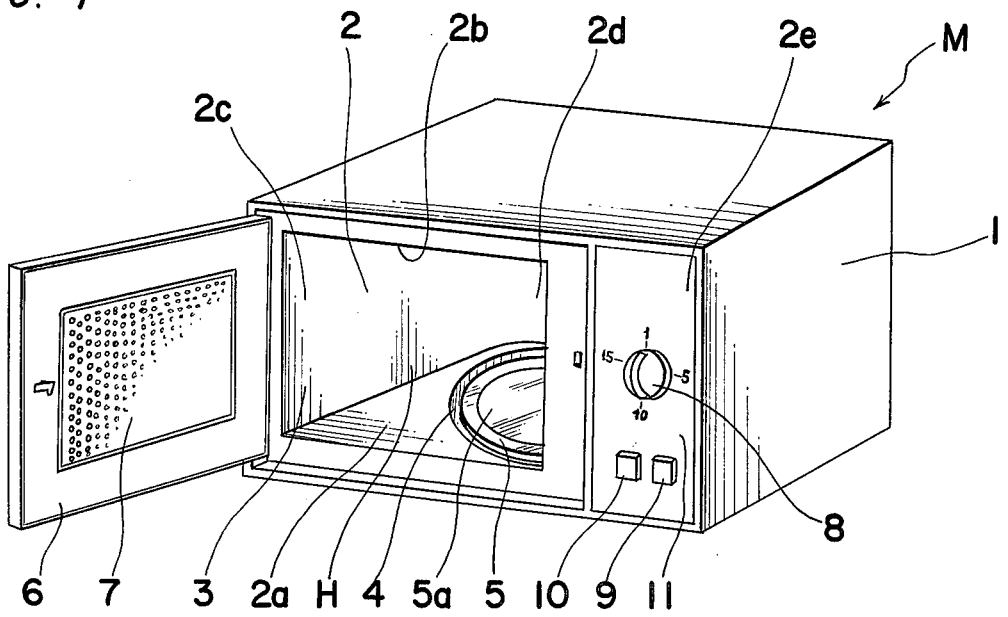
FIG. 1 is a perspective view of a microwave oven to which the present invention is applicable, with a door thereof in an opened state.

Before the description of the present invention proceeds, it is to be noted that like parts are designated by like reference numerals throughout the several views of the accompanying drawings.

Figure 3:
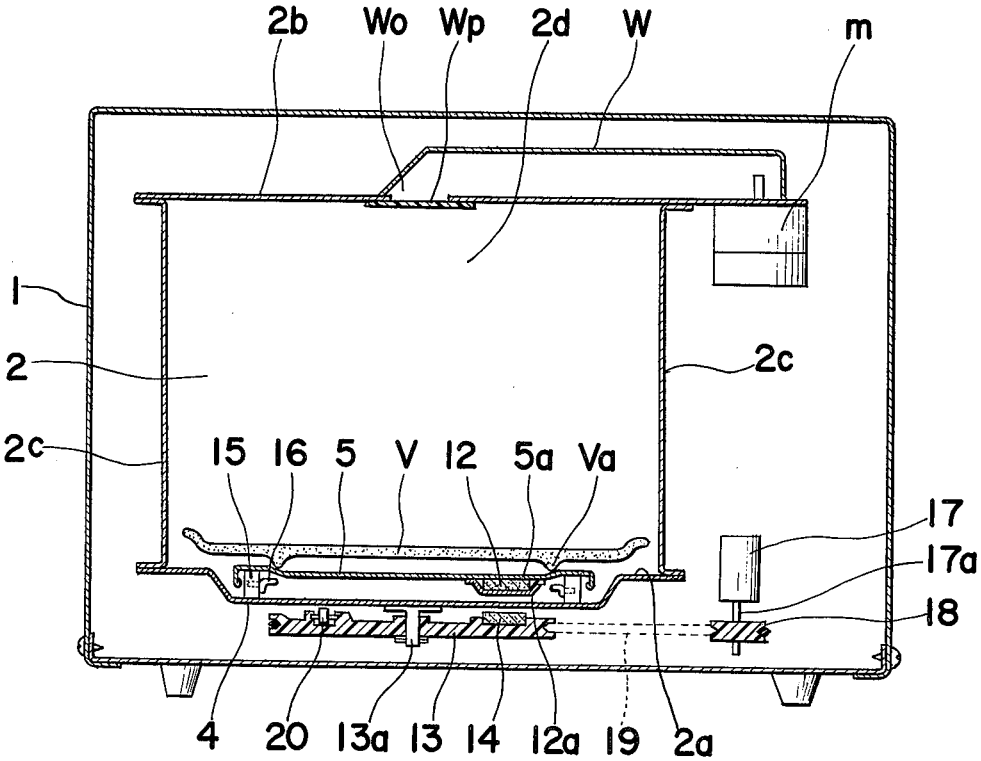
FIG. 3 is a cross sectional view taken along the line III—III of FIG. 2.
Figure 4:
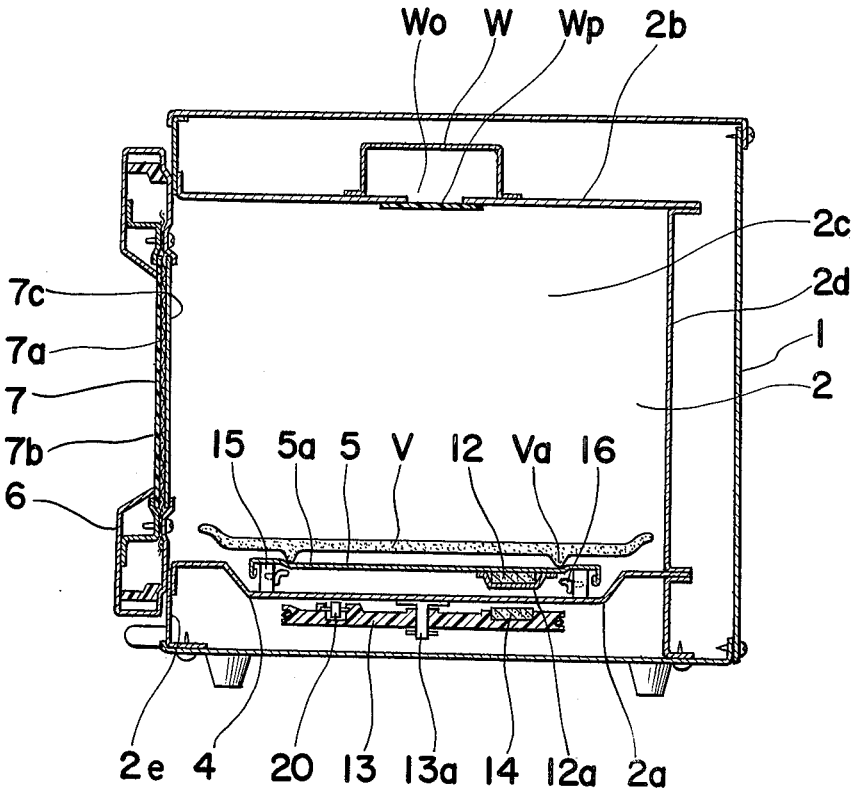
FIG. 4 is a cross sectional view taken along the line IV—IV of FIG. 2.

Referring now to the drawings, there is shown in FIG. 1 a microwave oven M to which the present invention may be applied. The microwave oven M is so arranged as to heat-treat objects or food material on the basis of dielectric heating through utilization of high frequency energy, for example, on the order of approximately 2,450 MHz, and generally includes an outer casing 1 of cubical box-like configuration open at the front side thereof. The outer casing 1 forms a double wall structure together with inner walls 2 which define a heating cavity or heating chamber H. The inner walls 2 include a horizontal bottom wall or base plate 2*a*, a top wall 2*b*, side walls 2*c* which are connected to or preferably, integrally formed with a concave rear wall 2*d* of semi-circular cross section to form a single wall of U-shaped configuration, and a front wall 2*e* defining an access opening 3 at the front of the microwave oven M. In approximately the central portion of the base plate 2*a*, there is formed a circular recess 4 in which a rotary table or turntable 5 is rotatably disposed in a manner described later. On the rotary table 5, a vessel or dish V (FIGS. 3 and 4) of glass or ceramic material is detachably mounted for accommodating therein the object or food material to be heated so that the vessel V can conveniently be taken out of the oven M when necessary. Furthermore, to make it easy to position the vessel V in place on the rotary table 5 and to prevent the vessel V from being displaced during rotation of the rotary table 5, there is formed in the upper surface of the table 5 a shallow recess 5*a* concentric with the rotary table 5, in which recess 5*a*, the bottom rim Va (FIGS. 3 and 4) of the vessel V is to be fitted when the vessel V is mounted on the table 5. Meanwhile, outer surfaces of the walls 2*a*, 2*b*, 2*c* and 2*d* are spaced from the corresponding walls of the outer casing 1. On the front wall 2*e*, in a position at the right hand side of the oven M as shown in FIG. 1 adjacent to the access opening 3, there is mounted a control panel 11 for controlling functioning of a high frequency oscillator and the like mentioned later, which control panel 11 carries thereon a timer operating knob 8, a cooking start button 9 for initiating high frequency heating, a function indicating lamp 10 which is illuminated during the high frequency heating and the like.

Further included in the microwave oven M is a door 6 preferably provided with a handle (not shown) adjacent to one edge thereof remote from a hinge at its other edge through which the door 6 is supported on the corresponding front edge of the outer casing 1 for pivotal movement about the hinge so as to selectively open and close the access opening 3. The door 6 has a rectangular observation window 7 formed approximately in the central portion thereof and including, for example, a punched metal sheet or wire netting 7*a* held between a transparent plate 7*b* of synthetic resin (FIGS. 2 and 4) disposed on its outer surface and a reinforced glass plate 7*c* provided on its inner surface confronting the heating chamber H for allowing the object (not shown) placed in the heating chamber H to be observed therethrough and simultaneously for preventing the high frequency energy from leaking out of the heating chamber H during operation of the microwave oven M.

Figure 2:
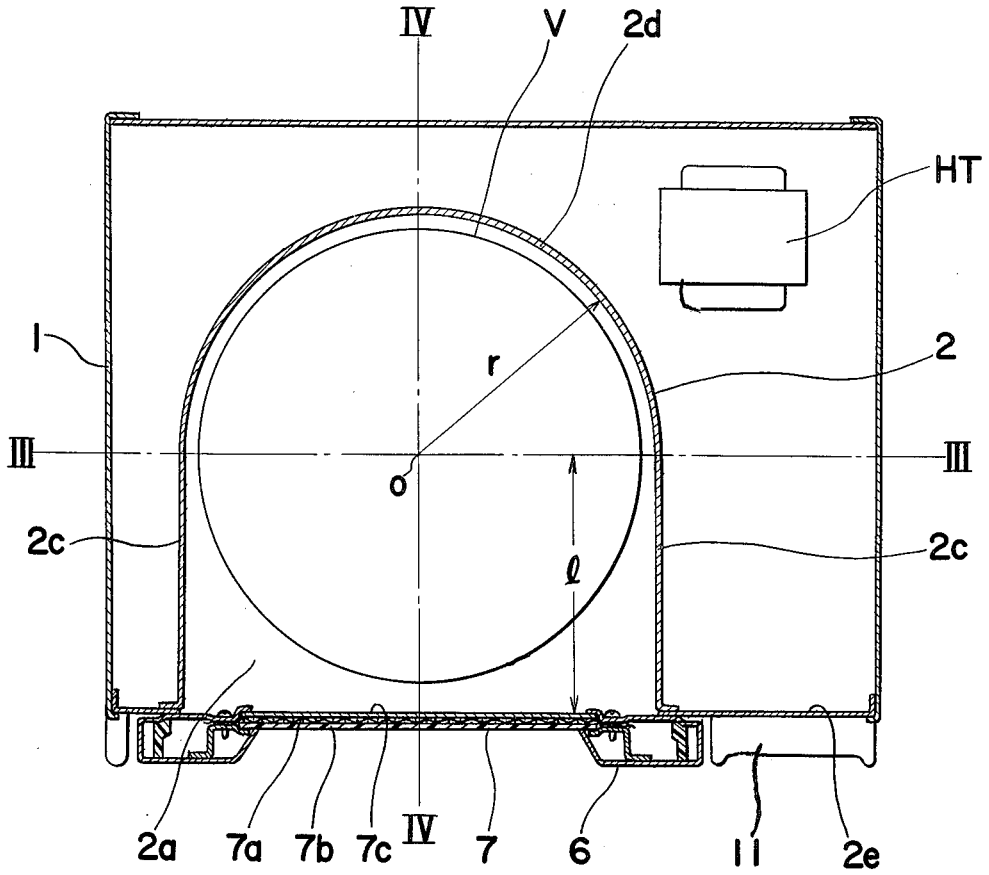
FIG. 2 is a sectional top plan view, on an enlarged scale, of the microwave oven of FIG. 1 with the door thereof closed.

Referring particularly to FIGS. 2 to 5, in a space defined by the top wall 2*b* of the heating chamber H and the corresponding top wall of the outer casing 1, there is disposed a wave guide W (FIG. 3) on the top wall 2*b* for transmitting the high frequency energy radiated by a magnetron assembly *m* toward an opening Wo formed in the top wall 2*b* to supply the same high frequency energy into the heating chamber H, with a partition plate Wp being provided at the opening Wo to prevent crumbs or chips and the like of the food material from entering the wave guide W, while a high voltage transformer HT for the magnetron assembly *m* is disposed in a space between the rear wall 2*d* and the corresponding wall of the outer casing 1 at a position confronting the rear wall 2*d* as shown in FIG. 2. Meanwhile, the rotary table 5 made of non-magnetic material, for example, stainless steel material, aluminum or the like is provided, at the lower surface thereof, with a plurality of permanent magnets 12 (FIGS. 3 and 4) arranged through an interval on an imaginary circle concentric with the rotary table 5 and suitably secured thereto, for example, through cover members 12*a* of non-magnetic material. The rotary table 5 is rotatably supported in the recess 4 of the base plate 2*a* by at least three rollers 15 each held in position by corresponding retaining rings 16 made, for example, of synthetic resinous material so that the rollers 15 are rotated upon rotation of the rotary table 5. Meanwhile, in the space defined by the base plate 2*a* of the heating chamber H and the corresponding bottom plate of the outer casing 1, there is rotatably disposed, through a shaft member 13*a* suitably secured to the under surface of the recess 4, a rotary member 13 in the form of a pulley at a position corresponding to the rotary table 5 and immediately below and adjacent to the under surface of the recess 4 of the base plate 2*a*. The rotary member 13 is provided, on its surface confronting the under surface of the recess 4, with driving magnets 14 at positions corresponding to the magnets 12 of the rotary table 5 so that upon rotation of the rotary member 13, the rotary table 5 is also rotated through magnetic coupling between the magnets 12 and 14, and also with a plurality of rollers 20 which rotatingly contact the under surface of the recess 4 during rotation of the rotary member 13 for stable rotation of the member 13 and also for maintaining the distance between the magnets 12 and 14 constant for uniform magnetic coupling therebetween.

The rotary member 13 is coupled through a belt 19 to a pulley 18 disposed in a horizontal direction to the member 13 and secured to a driving shaft 17*a* of a motor 17 which is housed in the space between the rear wall 2*d* of the heating chamber H and the corresponding rear wall of the outer casing 1 (FIG. 2).

Figure 5:
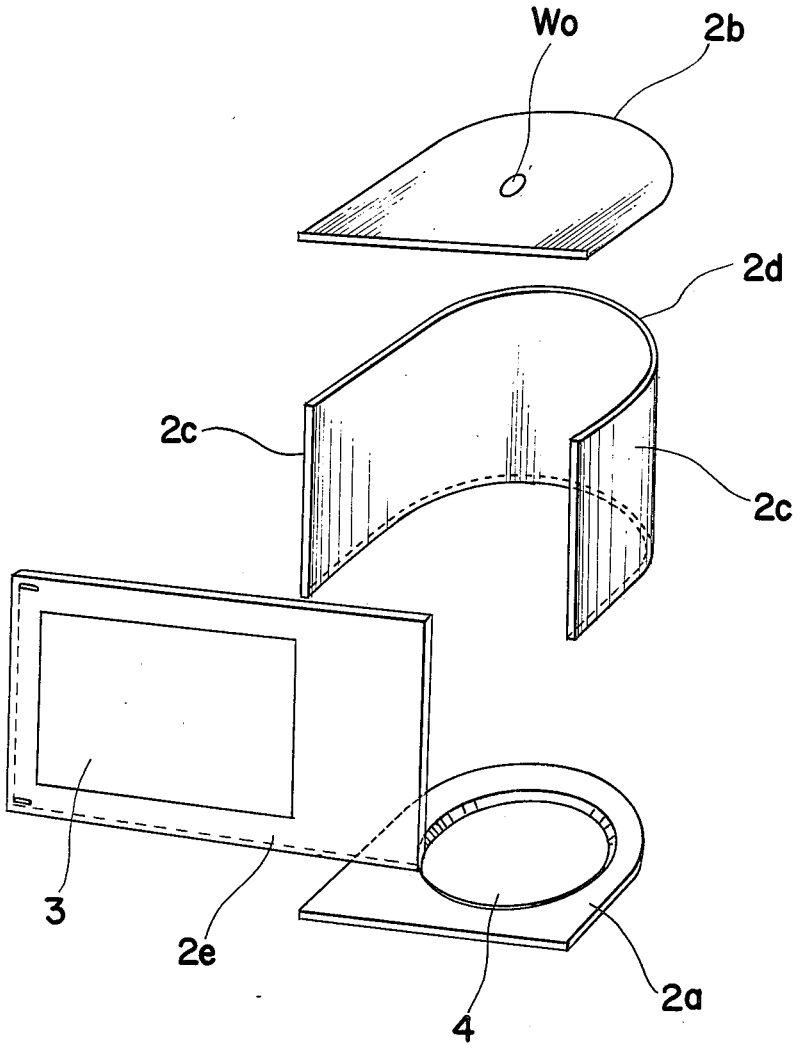
FIG. 5 is an exploded view showing the construction of a heating chamber employed in the microwave oven of FIG. 1.

In the above arrangement according to the present invention particularly characterized in the construction of the heating chamber H which includes the base plate 2*a* formed with the recess 4, top wall 2*b*, side walls 2*c* preferably integrally formed with the concave rear wall portion 2*d* of semi-circular cross section, and front wall 2*e* formed with the access opening 3 as most clearly seen in FIG. 5, favorable effects as follows can be achieved as compared with a microwave oven having the conventional arrangements.

1. Since the rear wall surface 2*d* is of concave shape as described above, any idle space which is not fully utilized within the heating chamber H is advantageously eliminated, thus resulting in compact size of the microwave oven itself.

2. By the elimination of corner portions at the rear wall portion 2*d* of the heating chamber H which are difficult of access for cleaning, the heating chamber H is not only free from accumulation of crumbs, chips or juice from the food material, but may readily be kept clean at all times, and thus undesirable corrosion of the walls 2 of the heating chamber H can be prevented.

3. Since the rear wall 2*d* of the heating chamber H has a semi-circular cross section approximately concentric with the rotary table 5, the gap between the vessel V and the rear wall 2*d* is kept approximately constant when the vessel V is mounted on the rotary table 5 with the bottom rim Va of the vessel V fitted into the shallow recess 5*a* formed in the upper surface of the table 5, thus making it easy to place the vessel V correctly on the table 5 at the first glance, and even if the vessel V is incorrectly placed it is pushed back by the concave rear wall portion 2*d* into a correct position during rotation of the rotary table 5, without giving rise to any inconveniences in the smooth rotation of the table 5.

4. Since the high voltage transformer HT is disposed in a space defined by the rear wall 2*d* and a corresponding wall of the outer casing 1 at a position confronting the rear wall 2*d*, the walls of the heating chamber H are not subjected to any resilient vibrations due to magnetic leakage, thus being free from generation of annoying vibrating noises.

5. The concave shape of the rear wall 2*d* of semi-circular cross section is particularly effective for the improvements of processability and workability, with the heating chamber H having increased strength as compared with that of the conventional heating chambers of rectangular box-like configuration, it thus being possible to reduce the thickness of the walls 2 for the heating chamber H and consequently the manufacturing cost involved therein.

6. Since the total area of the heating chamber H with respect to the electric waves is reduced, the total sum of wall surface loss for the heating chamber H is consequently decreased, with improved output efficiency especially at the time of small load.

7. In the driving of the rotary table 5 through the magnetic coupling, if expensive non-magnetic material, for example, aluminum, aluminum alloy, stainless steel of the austenite group and the like, is used only for the base plate 2*a* of the heating chamber H, with other main portions of the walls 2 being made of inexpensive magnetic material, heating chambers of low cost can be obtained.

Referring back to FIG. 2, when the radius $r$ of the concave semi-circular portion of the rear wall 2*d* is set to be smaller than the distance $l$ between the inner surface of the observation window 7 for the door 6 and the rotational center O of the rotary table 5, large sized objects to be heated and positioned so that they protrude from the rotary table 5 are not caught by any of the walls of the heating chamber H to lock the driving source, and tall objects will not be caused to fall down during the rotation of the rotary table 5, only if such an object is inserted into the heating chamber H without laterally contacting the walls of the heating chamber H, thus microwave ovens of improved safety being presented. Furthermore, the arrangement as described above is effective for preventing the disadvantage in the conventional microwave ovens that the glass plate 7*c* for the observation window 7 is damaged or the wire netting 7*a* therefor is broken by spark discharge from the metallic spit for the food material brought close to the window 7, since such a spit or the like is prevented from approaching the window 7 by the dimensional arrangement of $l > r$. Moreover, even when the inner glass plate 7*c* of the observation window 7 is replaced by a transparent plate of synthetic resin, the danger in the conventional arrangement that such a transparent plate is melted to form an opening thereat due to spark discharge between a metallic material approaching the observation window 7 and the wire netting 7*b* of the same window 7 is advantageously prevented by the arrangement of the present invention as described above.

It should be noted here that, in the foregoing description, although the present invention is mainly described with reference to a microwave oven having the rotary table driven by the magnetic coupling, the arrangement of the present invention is not limited in its application to microwave ovens with rotary tables of the magnetic coupling driving type, but may readily be applicable to microwave ovens having rotary tables directly driven by motors.

It should also be noted that the concept of the present invention to employ the concave rear wall portion of semi-circular cross section for the heating chamber is readily applicable even to microwave ovens without rotary tables for achieving uniform heating within the heating chamber.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A microwave oven comprising:

an oven defining structure;

a heating cavity within said oven defining structure, said heating cavity being defined by a base plate, a top wall, a front wall having an access opening therein, a pair of spaced substantially planar side walls, and a concave rear wall having a semi-circular cross-sectional configuration, said concave rear wall smoothly joining said side walls so that said rear wall and side walls together form a continuous wall member of U-shaped configuration;

door means for selectively opening and closing said access opening in said front wall;

means for supplying microwave energy into said heating cavity; and rotary table means of approximately circular shape, mounted within said heating cavity for rotation about a rotational axis, for receiving an object to be heated, said rotary table means being positioned within said heating cavity such that said semi-circular rear wall is concentric with said rotational axis.

2. A microwave oven as claimed in claim 1, wherein said base plate has therein a circular recess, said rotary table means being rotatably mounted within said recess.

3. A microwave oven as claimed in claim 2, further comprising a rotary member rotatably positioned adjacent the bottom surface of said recess in said base plate, said rotary member being provided with magnetic coupling means for rotatably driving said rotary table means upon rotation of said rotary member, said base plate being formed of a non-magnetic material, and said walls being formed of magnetic material.

4. A microwave oven as claimed in claim 1, wherein said side walls and said rear wall are integrally formed as a single member.

5. A microwave oven as claimed in claim 1, wherein said door means has therein an observation window, and the radius of curvature of said semi-circular rear wall is less than the distance between said rotational axis of said rotary table means the inner surface of said observation window.

* * * * *